United States Patent [19]

Imaizumi et al.

[11] Patent Number: 4,862,226

[45] Date of Patent: Aug. 29, 1989

[54] REFILL AND WASTE TONER CONTAINER WITH FORM CHANGING MEMBER

[75] Inventors: Masaru Imaizumi; Hiroyoshi Hayama, both of Osaka, Japan

[73] Assignee: Minolta Camera Kabushiki Kaisha, Osaka, Japan

[21] Appl. No.: 156,661

[22] Filed: Feb. 17, 1988

[30] Foreign Application Priority Data

Feb. 20, 1987 [JP] Japan ..... 62-23988[U]

[51] Int. Cl.[4] ..... G03G 15/00; G03G 21/00; B21F 45/16; B65D 1/02

[52] U.S. Cl. ..... 355/298; 141/84; 215/32; 222/DIG. 1

[58] Field of Search ..... 355/3 DD, 3 R, 133, 355/15; 141/1, 18, 84; 206/216, 524.1, 525, 816; 215/14, 31, 32, 226, 228, 230, 235, 263; 222/147, 153, 165, 325, 609, DIG. 1

[56] References Cited

U.S. PATENT DOCUMENTS

| | | | |
|---|---|---|---|
| 2,201,205 | 5/1940 | Samburg | 215/230 |
| 3,958,878 | 5/1976 | Smith et al. | 355/15 |
| 4,732,277 | 3/1988 | Smith | 206/216 X |

FOREIGN PATENT DOCUMENTS

| | | | |
|---|---|---|---|
| 58-153983 | 9/1983 | Japan . | |
| 0057263 | 4/1984 | Japan | 355/3 DD |
| 0062882 | 4/1984 | Japan | 355/3 DD |
| 60-46566 | 4/1985 | Japan . | |
| 0121473 | 6/1985 | Japan | 355/3 DD |
| 61-37008 | 10/1986 | Japan . | |

*Primary Examiner*—A. T. Grimley
*Assistant Examiner*—Edward Pipala
*Attorney, Agent, or Firm*—Wenderoth, Lind & Ponack

[57] ABSTRACT

A toner container is detachably attached to a developing device and used for supplying a developing agent held therein to the developing device. The toner container, after completing supply of the toner, is then detachably attached at a position suitable for recovering developing agent remaining on an electrostatic latent image carrier, and allowed to accommodate therein the recovered developing agent. A main body of the toner container accommodates the developing agent. A mouth is formed in the main body, and is adapted to effect supply or recovery of the developing container. A form-changing member effects a change in the form of the main body when the main body is attached in the position for recovery of the remaining developing agent to indicate that the toner container has already been used as a supply container.

15 Claims, 6 Drawing Sheets

REFILL AND WASTE TONER CONTAINER WITH FORM CHANGING MEMBER

BACKGROUND OF THE INVENTION

1. Field of the Invention:

This invention relates to a toner container. More particularly, it relates to a toner container to be used in a copying machine.

2. Description of the Prior Art:

A technique for using one container concurrently for supply and recovery of developing agent has been disclosed in Japanese Patent Laid-Open SHO 58(1983)-153,983, which technique discloses that the container holding therein the developing agent for supply in a developing unit is disposed at the developing unit. After the container has completely discharged its role as a supply container, the container, now in an empty state, is allowed to be retained with a retaining device at a position suitable for collection of the developing agent used and recovered in a cleaning unit. The container, after the recovery of the used developing agent has been completed, is tightly sealed at an upper opening of the supply container with a sealing member in order for the container to be discarded safely. Japanese Utility Model Laid-Open SHO 60(1985)-46,566 discloses a toner container holding therein a fresh supply of toner, and is provided in the opening part thereof with a member adapted to close the opening part. Separately, a container to be used both for supply and recovery of toner has been disclosed which is provided at some other portion of the toner container with a memeber adapted to close the opening part once opened for supply of the toner. In Japanese Utility Model Publication SHO 61(1986)-37,008, there is disclosed a container for supply and recovery of toner, wherein a developing agent cartridge is so adapted as to be set first in a developing unit to permit supply of the developing agent to the developing unit and, after the developing agent held therein has been used up, allowed to be detachably disposed at a position proper for receiving the used developing agent being cleaned and recovered.

Of the three techniques of the prior art described above, those of Japanese Patent Laid-Open SHO 58(1983)-153,983 and Japanese Utility Model Laid-Open SHO 60(1985)-46,566 are characterized by the fact that the container holding the fresh supply (unused) of toner-containing developing agent (hereinafter referred to as "developing agent") is provided with a member for tightly sealing (closing) the opening part of the container. This container is further provided, at some other portion thereof and separately from the tightly sealing member (closing member), with a member for tightly sealing (closing) the opening part of the container after the used developing agent has been cleaned and recovered. These two inventions, however, do not teach any means for presenting a morphologically characteristic part providing a clear answer to the question as to whether the container used both for supply and recovery of the developing agent is holding the developing agent to be used for supply or whether it is holding the used developing agent which has been recovered. They are, therefore, liable to entail the possibility that a container already filled with recovered developing agent will be inadvertently set again in the developing unit. The remaining invention, i.e. the invention of Japanese Utility Model Publication SHO 61(1986)-37,008, similarly has the possibility that the container which has been filled up with the recovered developing agent will be reset as a toner supply container in the developing unit.

SUMMARY OF THE INVENTION

An object of this invention, therefore, is to provide a novel toner container.

Another object of this invention is to provide a toner container used for a copying machine preventing the possibility of entailing erroneous handling at the time of attachment to the copying machine.

The objects described above are attained by a toner container of the type to be attached detachably to a developing device and used for supplying a developing agent held therein to the developing device. The toner container, on completing supply of the toner, is detachably attached at a position appropriate for recovering the developing agent remaining on an electrostatic latent image carrier, and then allowed to accommodate therein the recovered developing agent. A main body of the toner container accommodates the developing agent. A mouth is formed in an upper portion of the main body and provided with an opening for supplying or recovering the developing agent. A member is attached to the mouth without obstructing the opening, the member being allowed to fit fast onto the mouth at the time that the toner container is to be disposed at the position suitable for recovery of the developing agent remaining on the electrostatic latent image carrier after the supply of the toner to the developing device is completed.

The objects described above are also attained by a toner container of the type to be attached detachably to a developing device and used for supplying a developing agent held therein to the developing device. The toner container, on completing supply of the toner, is detachably attached to a cleaning device for recovering the developing agent remaining on an electrostatic latent image carrier, and then allowed to accommodate therein the recovered developing agent. A main body of the toner container accommodates the developing agent. A mouth formed in an upper portion of the main body and provided with an opening for supplying or recovering the developing agent. The mouth is further provided with a separation portion adapted to permit separation of the mouth from the main body, the mouth being separated from the main body across the portion for separation during the attachment of the toner container to the cleaning device.

The objects described above are also attained by a toner container of the type to be attached detachably to a developing device and used for supplying a developing agent held therein to the developing device. The toner container, on completing supply of the toner, is detachably attached to a cleaning device for recovering developing agent remaining on an electrostatic latent image carrier, and then allowed to accommodate therein the recovered developing agent. A main body of the toner container accommodates the developing agent. The main body is provided with a first mouth for feeding into the main body the developing agent recovered from the cleaning device. A pierceable closing member is adapted to cover the first mouth, the closing member being adapted to be broken by the cleaning device when the toner container is attached to the developing device. A second mouth is formed in the upper portion of the main body and has an opening for supplying the developing agent. A cover member is provided, being incapable of covering the second mouth when the toner container is attached to the developing device and capable of covering the second mouth when the toner container is attached to the cleaning device.

The objects described above are attained by a toner container of the type to be attached detachably to a developing device and used for supplying a developing agent held therein to the developing device. The toner container, on completing supply of the toner, is detachably attached at a position suitable for recovering developing agent remaining on an electrostatic latent image carrier, and then allowed to accommodate therein the recovered developing agent. A main body of the toner container accommodates the developing agent. A mouth is formed in the upper portion of the main body, and is provided with an opening for supplying or recovering the developing agent. A form-changing member is attached to the toner container so as to effect a change in the form of the toner container when the toner container, after having completed supply of the toner, is attached to the position suitable for recovery of the remaining developing agent.

The objects described above are also attained by a toner container of the type to be attached detachably to a developing device and used for supplying a developing agent held therein to the developing device. The toner container, on completing supply of the toner, is detachably attached at a position suitable for recovering the developing agent remaining on an electrostatic latent image carrier, and then allowed to accommodate therein the recovered developing agent. A main body of the toner container accommodates the developing agent. A mouth is formed in the upper portion of the main body and provided with an opening for supplying or recovering the developing agent. A separation portion is adapted to be separated from the toner container so as to effect a change in the form of the toner container when the toner container, after having completed supply of the toner, is attached at the position suitable for recovery of the remaining developing agent.

The toner container of the present invention is constructed so that, after the container, attached to the developing device in a position suitable for supplying the developing agent to the developing device, has fulfilled its role as a supply container, and before the container is attached as a recovery container at a position suitable for receiving the developing agent being cleaned and recovered, part of the container is cut off or an adapter is attached or fastened to the container. In other words, the container is provided with a form changing part adapted to change the form of the container in such a manner that the user is allowed to tell easily whether the container is in the state of a supply container for supplying unused developing agent or in the state of a recovery container for accommodating the recovered developing agent. As a result, the container is prevented from the possibility of being inadvertently attached as a supply container to the developing device after having been used as a recovery container.

DETAILED DESCRIPTION OF THE PREFERRED EMBODIMENTS

Now the embodiments of the present invention will be described with reference to the accompanying drawings.

Figure 1:
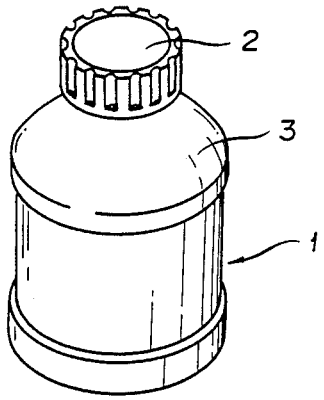
FIG. 1 is a perspective view of a toner supply bottle of a first embodiment of this invention.
Figure 2:
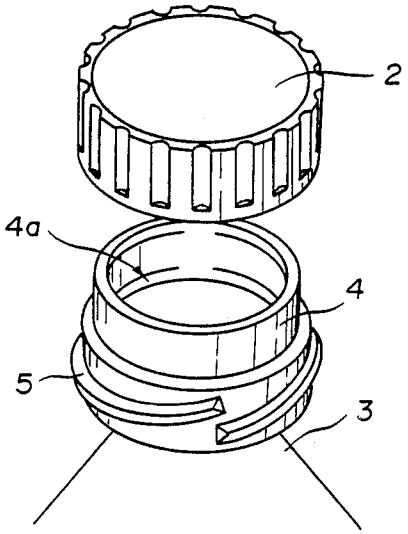
FIG. 2 is a magnified view illustrating a cap of the bottle of FIG. 1 and a mouth of the bottle provided with a tubular opening.

FIG. 1 is a perspective view illustrating a toner supply bottle, i.e. the main body of a toner container, as a first embodiment of this invention and FIG. 2 is a magnified view illustrating a cap for the bottle and a mouth of the bottle provided with a tubular opening.

A toner supply bottle 1 holding a supply of toner comprises a bottle body 3 having a mouth 4 provided with a tubular opening **4*a* and a cap 2 for tightly sealing the mouth 4. The mouth 4 encircling the tubular opening 4*a* is provided thereon with a male thread 5 and the cap 2 is provided on the inner side thereof with a female thread (not shown) matched with the male thread. These threads ensure safe union between the cap 2 and the mouth 4. More specifically, they cooperate to seal a gap formed between the cap 2 and the mouth 4 so tightly so as to prevent the toner held in the toner supply bottle 1** from accidental leakage through the gap.

Figure 3:
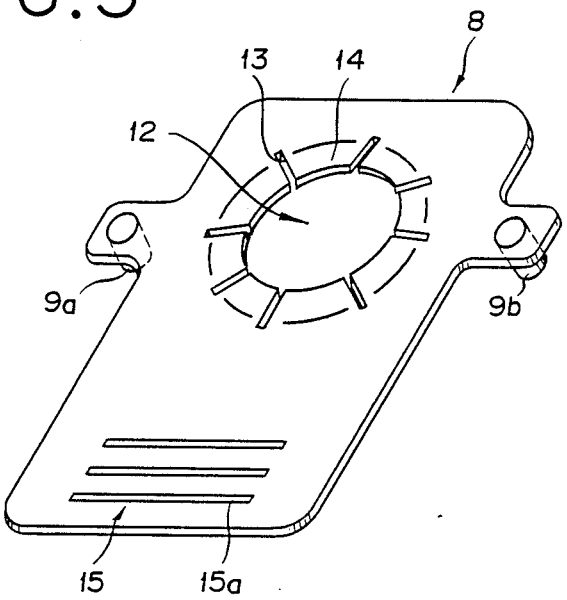
FIG. 3 is a perspective view showing the appearance of a shape changing part to have inserted therein the bottle of the first embodiment after the supply of toner is completed.
Figures 4, 5:
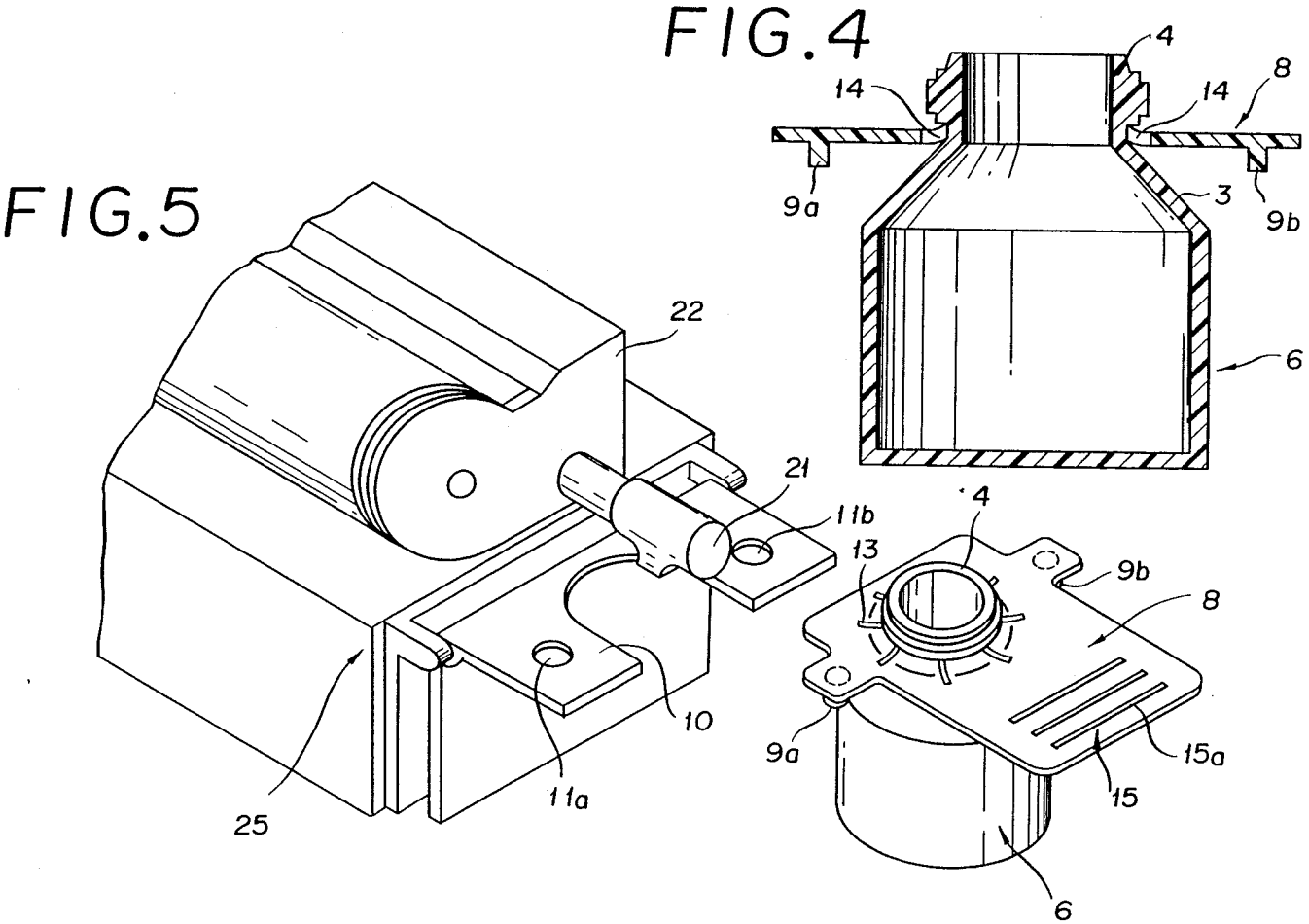
FIG. 4 is a cross section of a used toner bottle in the state where it is inserted in the form changing part.
FIG. 5 is a perspective view schematically illustrating the toner bottle of the first embodiment of the present invention poised for attachment to a bottle fitting part of a copying machine after completion of the supply of toner.

When the toner supply bottle 1 has fulfilled its role as a supply container, it is ready for attachment as a recovery container (an empty toner bottle 6) at a position appropriate for recovery of used toner (to be described fully later on). A fitting member 8 having a construction illustrated in FIG. 3 is fitted around the empty toner bottle 6 (illustrated in FIG. 4). The toner bottle 6, in the state having a fitting member 8 fitted thereon, is illustrated in cross section in FIG. 4. The toner bottle 6 having the fitting member 8 fitted thereon is poised for attachment at a prescribed position aligned with a discharge pipe 21 for the used toner, which has been cleaned by a cleaner box 22 (described fully later on) of the copying machine, and readied for recovery, as illustrated in FIG. 5. It is emphasized here that the toner supply bottle 1 and the toner bottle 6 are two forms of one and the same bottle.

The fitting member 8 is a substantially flat plate, as illustrated in FIG. 3, and is provided on its opposite sides with protruding parts 9*a* and 9*b*. These protruding parts 9*a* and 9*b* are fitted in holes 11*a* and 11*b* bored in a container retaining member 10 of a device 25 illustrated in FIG. 5, and prevent the fitting member 8 from falling off of the container retaining member 10. Substantially in the central part of the fitting member 8 is formed a through hole 12 adapted to fit the fitting member 8 around the toner bottle 6. In a peripheral portion 14 of the through hole 12 are a plurality of slits 13, radially incised and circumferentially spaced. The peripheral portion 14 containing the slits 13, during the fitting of the fitting member 8 around the upper part of the toner bottle 6, deforms to facilitate the insertion of the bottle. Further, the peripheral portion 14 of the through hole 12 is slightly curved toward the upper side of the fitting member 8, as illustrated in FIG. 4, lest the fitting member 8 fitted around the toner bottle 6 should slip off the toner bottle 6. The peripheral portion 14 of the fitting member 8 must be formed with a material abounding with force of restitution, i.e. the force of a material tending to restore it to its original shape, so that the peripheral portion 14 deforms amply to permit the ready fitting of the fitting member 8 around the toner bottle 6 and, once fastened in position, keeps firm hold of the toner bottle 6. Examples of materials which meet this requirement are flexible resins such as polyolefins, e.g., polyethylene and polypropylene, flexible vinyl chloride resin and polystyrene, and particularly flexible thermoplastic resins. This material, nevertheless, need not be limited to those cited above. Where the fitting member is formed with resin, the protruding parts 9*a* and 9*b* can be integrally formed with the fitting member 8.

The fitting member 8 serving as an adapter is further provided, as illustrated in FIG. 3, with a handle 15 adapted to be held conveniently in a hand after the toner bottle 6 has been inserted in the fitting member. This handle 15 is provided, when necessary, with at least one projected strip or groove 15*a* on either or both of the opposite surfaces of the fitting member. The fitting member 8, when the toner bottle 6 is inserted therein, serves as a sign indicating that the toner bottle 6 is fulfilling its role as a recovery container and not as a supply container. It precludes the possibility of a bottle 6, having discharged its role as a recovery container, from being set again in the toner supply device.

Figure 6:
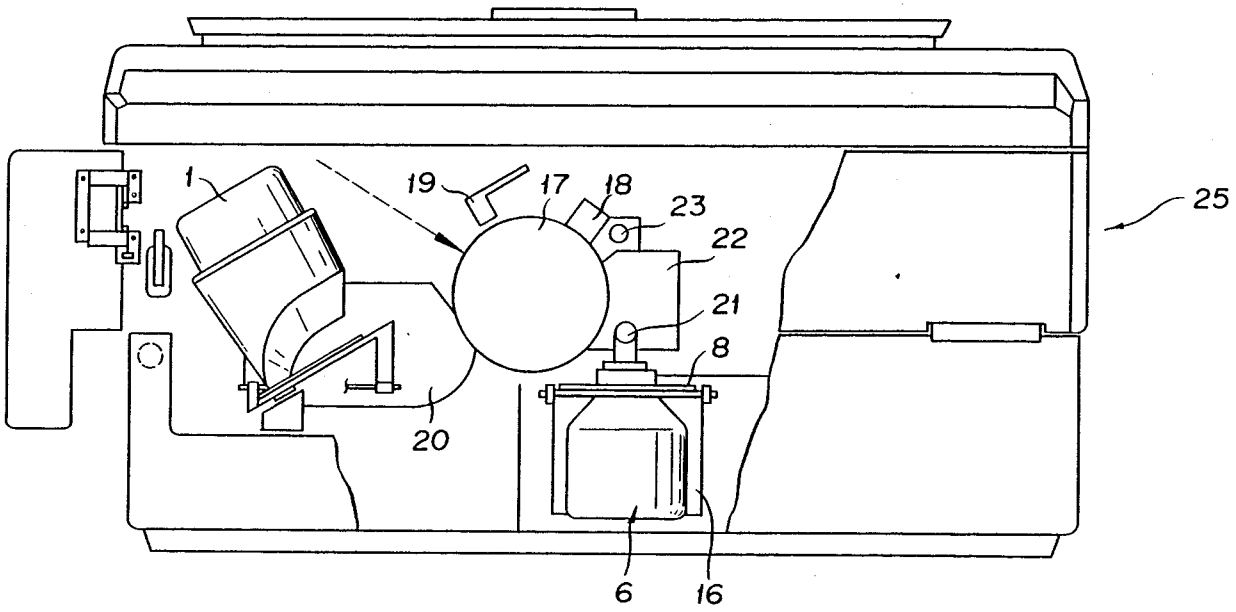
FIG. 6 is a partially cutaway schematic diagram illustrating the main body of a copying machine in a state having the toner bottle of the first embodiment of this invention set in a toner supply device and in a used toner recovery device.

FIG. 6 illustrates a copying machine 25 in which the toner supply bottle 1 is attached as a supply container to the developing device and, at the same time, an empty toner bottle 6 having the fitting member 8 fitted thereon is attached to a used toner bottle supporting plate 16. In this case, the toner bottle 6 functions as a recovery container. FIG. 6 depicts more clearly the fact that the toner supply bottle of FIG. 1 is used for both supply and recovery of toner.

In the construction of FIG. 6, the copying machine 25 is provided substantially in the central portion thereof with a photosensitive drum 17. Around the photosensitive drum 17 are disposed an electric charger 18, an image eraser 19, a developing device 20 having the toner supply bottle 1 fitted therein, the used toner bottle supporting plate 16 for supporting the toner bottle 6 having the fitting member 8 fitted therein, a used toner discharge pipe 21 serving to introduce cleaned used toner into the used toner bottle 6, collector box 22, and an erasing lamp 23. The arrow of a dotted line shown in FIG. 6 indicates the direction in which the beam of incident light reaches the photosensitive drum 17.

The toner supply bottle 1, for supply of the toner to the developing device 20, is attached at the position indicated in FIG. 6. It is repeated once again that the bottle 1, when emptied of its contents, turns into the used toner bottle 6.

Figure 7:
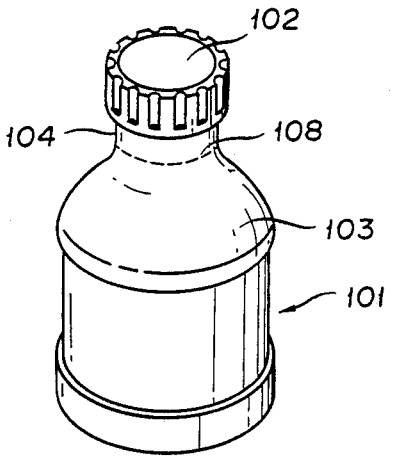
FIG. 7 is a perspective view illustrating the appearance of a toner supply bottle of a second embodiment of the present invention in a state ready for use.
Figure 8:
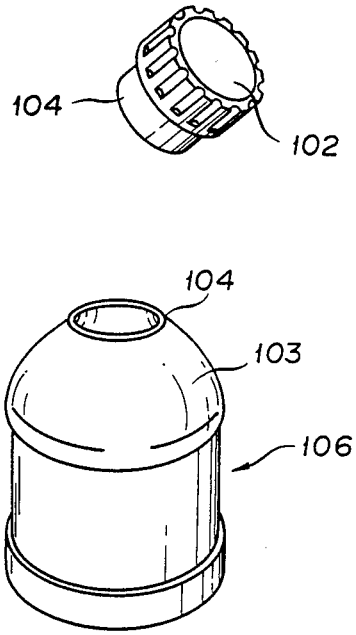
FIG. 8 is a perspective view illustrating the appearance of the toner supply bottle of the second embodiment in a state ready for use as a used toner bottle, with a separable marginal part cut off to display a change of shape.

Now, the second embodiment of this invention will be described below with reference to FIGS. 7 through 10. FIG. 7 illustrates a toner supply bottle 101 as a second embodiment of this invention in a state ready for use. As illustrated in FIG. 7, the toner supply bottle 101 comprises a cap 102, a mouth 104 enclosing a tubular opening, a bottle body 103, and a marginal portion 108 used for separation, which functions as a form changing portion. When the supply of toner is completed and the toner supply bottle 101 is emptied, the marginal portion 108 used for separation from the bottle 101 is cut off, as illustrated in FIG. 8. To facilitate the separation, the portion of the bottle body corresponding to the marginal portion 108 is formed with a small wall thickness at the time the bottle is molded. When the cap 102 fitted around the mouth is powerfully turned, the twist consequently exerted causes the marginal portion 108 used for separation, formed with a small wall thickness, to be sheared, so that the bottle is separated into two parts, as illustrated in FIG. 8.

Figure 9:
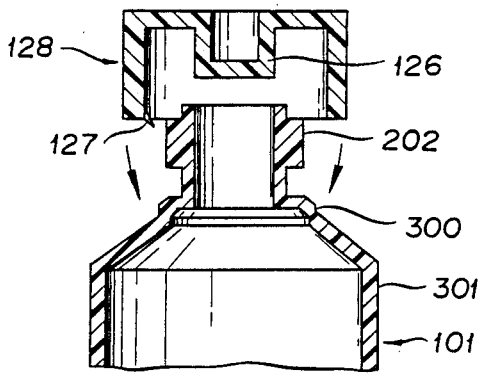
FIG. 9 is a partial cross section illustrating the margin of the bottle of FIG. 8 for separation in the state being cut by the use of a cutter as a tool for the separation.
Figure 10:
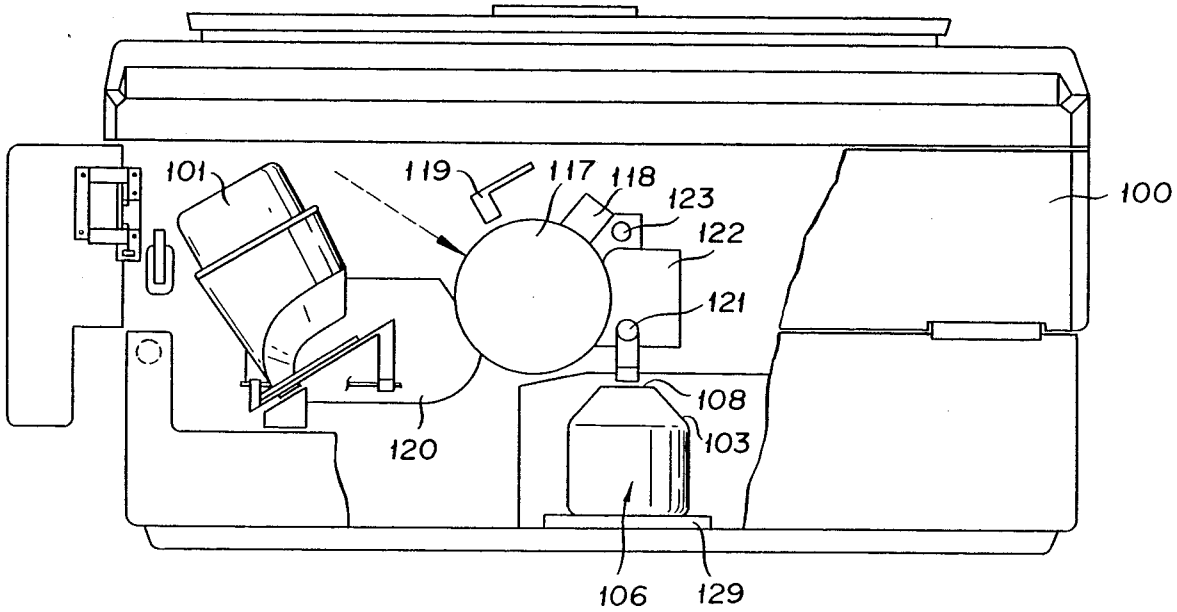
FIG. 10 is a schematic structural diagram illustrating the toner bottle of the second embodiment in the state set in the toner supply position and the used toner recovery position of a copying machine.

Otherwise, the cutting of the marginal portion 108 used for separation may be effected by separately providing a cutting member 128, having on the inner side of a top portion thereof a protuberance 126 having an outside diameter equal to or slightly smaller than the inside diameter of the mouth 104. At a suitable position is a blade 127 as illustrated in FIG. 9 and by rotating the cutting member about its axis, the marginal portion is cut. The primary object of the cutting of the marginal portion 108 of the toner suppy bottle 101 resides in providing a morphological feature enabling the user to tell clearly whether the bottle is in a supply state or in a recovery state. The second object of this cutting resides in preventing the leading end of a used toner discharge pipe 121 of a copying machine 125 from colliding into the mouth 104 of the toner supply bottle 101 as illustrated in FIG. 10 when the toner supply bottle 101 is ready for use as a used toner bottle 106. FIG. 10 illustrates a construction in which a toner bottle 101 having the mouth 104 separated therefrom is mounted as a used toner bottle 106 on a used toner bottle setting plate 129 of the copying machine 125, and a toner supply bottle 101 in an unused state is set in the developing device 120. In the construction of FIG. 10, similarly to that of FIG. 6, an electric charger 118, an image eraser 119, a developing device 120 having the toner supply bottle 101 fitted therein, the used toner bottle 106, the used toner discharge pipe 121 serving to feed used toner into the used toner bottle 106, a cleaner box 122, and an erasing lamp 123 are disposed around a photosensitive drum 117. The arrow of a dotted line shown in FIG. 10 indicates the direction in which a beam of incident light reaches the photosensitive drum 117. Of course, the toner supply bottle 101 and the used toner bottle 106 are two forms of one and the same bottle.

Figure 11:
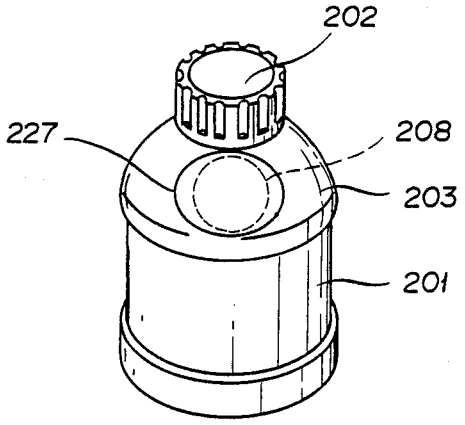
FIG. 11 is a perspective view illustrating the appearance of a toner supply bottle of a third embodiment of this invention in a state ready for use.
Figure 12:
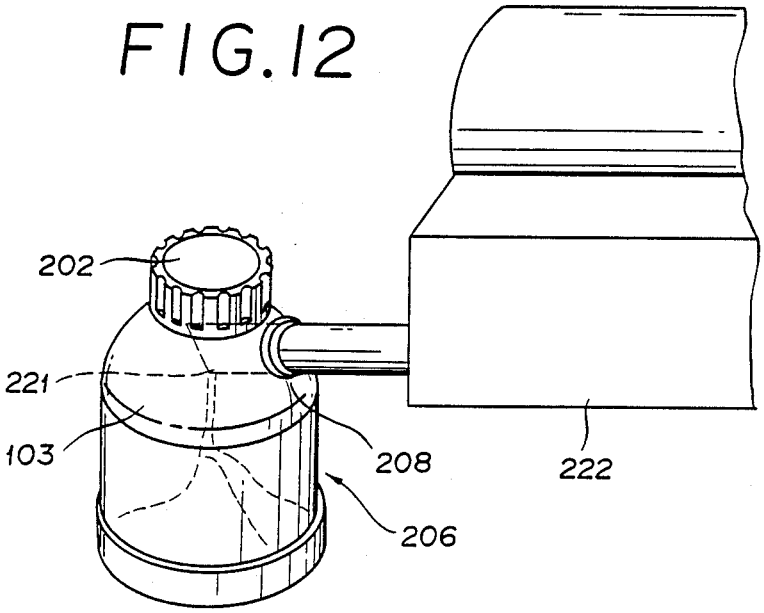
FIG. 12 is a perspective view schematically illustrating the toner supply bottle of FIG. 11 in state connected to a used toner discharge tube of a cleaner box of a copying machine to be used as a used toner bottle subsequently to the use thereof as a toner supply bottle.

Now, the third embodiment of the present invention will be described below with reference to FIGS. 11 and 12. FIG. 11 is a perspective view illustrating a toner supply bottle 201 as a third embodiment of this invention in an unused state. In other words, the toner supply bottle 201, which comprises a cap 202, a bottle body 203, an opening 208 formed as a form-changing portion in the bottle body 203, and a pierceable closing member 227 made of a film or sheet and disposed to block up the opening 208, is illustrated in a state ready for use. During the supply of the toner, the cap 202 is kept removed and the toner is supplied to the developing device (not shown) through the mouth (not shown) formed in the upper end of the bottle. After completion of the supply of toner to the developing device, the bottle is used as a used toner bottle 206 with the cap 202 secured in position (generally by means of matched threads). In this case, the used toner bottle 206 is attached to a used toner discharge pipe 221 of a cleaner box 222 by having the discharge pipe 221 thrust past the closing member 227, as illustrated in FIG. 12. The leading end of the used toner discharge pipe 221 is sharply pointed, so as to readily force its way through the film of the closing member 227 during attachment. Again in the present embodiment, the toner supply bottle 201 is used as a used toner bottle 206 after completion of the supply of the toner as described above. In the present embodiment, the toner is supplied to the developing device through the mouth in the upper end of the bottle 201 during the supply of toner, and the used toner is recovered through the opening 208 formed in the bottle body 203 of the bottle 206 (201) during the recovery of the used toner. For the purpose of closing the opening 208 after the recovery of the toner is completed, a tightly sealing member (not shown) different in shape and display color from the closing member 227 is kept attached to the bottle from the beginning, or is provided separately. In this case, the shape and display color of the tightly sealing member attached fast to the opening 208 enables the user to tell whether the bottle is in the state of recovery or in the state of supply.

The multi-functional container contemplated by the present invention is provided with a form-changing portion used such as a marginal portion for separation, an adapter, or a tightly sealing member which effects a change in the form of the toner supply bottle when this bottle is to be diverted into a used toner bottle. By means of this form-changing portion, the user is able to tell definitely whether the toner bottle is serving as a supply container, or as a recovery container. Thus, the possibility of the used toner bottle from being inadvertently used as a toner supply bottle once again can be safely precluded.

What is claimed is:

1. A toner container arrangement for detachable attachment to a developing device for supplying developing agent to said developing device, and, after developing agent has been supplied to said developing device for detachable attachment at a position suitable for recovering developing agent remaining on an electrostatic latent image carrier, the toner container arrangement comprising:

a main toner container body for accommodating developing agent therein, said main toner container body including an upper portion;

a mouth formed in said upper portion of said main toner container body, said mouth including an opening through which developing agent is supplied and recovered; and an attaching member means attachable to said mouth of said main toner container body without obstructing said opening of said mouth, said attaching member means fixed to said mouth when said main toner container body is disposed at said position suitable for recovering developing agent remaining on said electrostatic image carrier and after said main toner container body has supplied developing agent to said developing device, and said attaching member means, when attached to said main toner container body, rendering said main toner container body unable to be reattached to said developing device to supply developing agent to said developing device.

2. The toner container arrangement as set forth in claim 1, wherein:

said attaching member means comprises a member which has a through hole therein for receiving said mouth of said main toner container body when said main toner container body is attached to said member.

3. The toner container arrangement as set forth in claim 2, wherein:

said through hole of said member has a peripheral portion provided with a plurality of radially disposed and circumferentially spaced slits.

4. The toner container arrangement as set forth in claim 1, wherein:

said attaching member means is provided with a protruding portion for fixing said attaching member means and said main container body attached to said attaching members means at said position on said developing device suitable for recovering developing agent remaining on said electrostatic latent image carrier.

5. The toner container as set forth in claim 4, wherein:

said attaching member means comprises a member which said attaching member is made of a flexible resin.

6. The toner container as set forth in claim 5, wherein:

said member has at least one said protruding portion disposed on each opposite side of said member.

7. The toner container as set forth in claim 6, wherein:

said member has a handle at one end thereof, said handle having opposite surfaces, at least one of said opposite surfaces having thereon a projecting strip or groove.

8. A toner container arrangement for detachable attachment to a developing device for supplying developing agent to said developing device, and, after developing agent has been supplied to said developing device, for detachable attachment to a cleaning device for recovering developing agent remaining on an electrostatic latent image carrier, the toner container arrangement comprising:

a main toner container body for accommodating developing agent therein, said main toner container body including an upper portion;

a mouth formed in said upper portion of said main toner container body, said mouth including an opening through which developing agent is supplied and recovered, said mouth having a separation means for enabling separation of said mouth from said main toner container body after developing agent has been supplied to said developing device to enable said main toner container body to be attached to said cleaning device, said separation means including a separation portion extending across said mouth, said mouth being separated from said main toner container body at said separation portion.

9. The toner container as set forth in claim 8, wherein:

said separation portion is formed by a region of said mouth having a wall thickness smaller than the wall thickness of said main toner container body.

10. A toner container arrangement for detachable attachment to a developing device for supplying developing agent to said developing device, and, after developing agent has been supplied to said developing device, for detachable attachment to a cleaning device for recovering developing agent remaining on an electrostatic latent image carrier, the toner container arrangement comprising:

a main toner container body for accommodating developing agent therein, said main toner container body including an upper portion;

said main toner container body having a first mouth for receiving developing agent recovered by said cleaning device and a piercable closure member covering said first mouth, said piercable closure member adapted to be pierced by said cleaning device as said main toner container body is attached to said cleaning device;

said upper portion of said main toner container body having a second mouth, said second mouth including an opening through which developing agent is supplied to said developing device; and cover means for uncovering said second mouth when said main toner container body is attached to said developing device to supply developing agent to said developing device and for covering said second mouth when said main toner container body is attached to said cleaning device.

11. The toner container arrangement as set forth in claim 10, wherein:

said closure member comprises a film or sheet material, and is fastened to a peripheral portion of said first mouth.

12. A toner container arrangement for detachable attachment to a developing device for supplying developing agent to said developing device, and, after developing agent has been supplied to said developing device, for detachable attachment at a position suitable for recovering developing agent remaining on an electrostatic latent image carrier, the toner container arrangement comprising:

a main toner container body for accommodating developing agent therein, said main toner container body including an upper portion;

a mouth formed in said upper portion of said main toner container body, said mouth including an opening through which developing agent is supplied and recovered; and form changing means, attached to said main toner container body after said main toner container body has supplied developing agent to said developing device and before said main toner container body is attached at said position suitable for recovering developing agent, for indicating that said main toner container body has already been used to supply developing agent to said developing device by changing the form of said main toner container body.

13. The toner container arrangement as set forth in claim 12, wherein:

said form changing means comprises a form changing member having a through hole therein for receiving said mouth of said main toner container body when said form changing means is attached to said main toner container body.

14. The toner container as set forth in claim 13, wherein:

said through hole of said form changing member has a peripheral portion provided with a plurality of radially disposed and circumferentially spaced slits.

15. A toner container arrangement for detachable attachment to a developing device for supplying developing agent to said developing device, and, after developing agent has been supplied to said developing device, for detachable attachment at a position suitable for recovering developing agent remaining on an electrostatic latent image carrier, the toner container arrangement comprising:

a main toner container body for accommodating developing agent therein, said main toner container body including an upper portion;

a mouth formed in said upper portion of said main toner container body, said mouth including an opening through which developing agent is supplied and recovered; and separable means separated from said main toner container body after said main toner container body has supplied developing agent to said developing device and before said main toner container body is attached at said position suitable for recovering developing agent for indicating that said main toner container body has already been used to supply developing agent to said developing device by changing the form of said main toner container body, said separable means comprising a separable portion of said main toner container body.

* * * * *